US006052923A

United States Patent [19]

McMullin

[11] Patent Number: 6,052,923

[45] **Date of Patent: *Apr. 25, 2000**

[54] GOLF CLEAT

[75] Inventor: Faris W. McMullin, Boise, Id.

[73] Assignee: Softspikes, Inc., Gaithersburg, Md.

[ * ] Notice: This patent is subject to a terminal disclaimer.

[21] Appl. No.: 09/209,252

[22] Filed: Dec. 10, 1998

Related U.S. Application Data

[63] Continuation of application No. 08/823,901, Mar. 25, 1997, abandoned.

[60] Provisional application No. 60/034,328, Dec. 20, 1996.

[51] Int. Cl.[7] ..... A43B 5/00; A43C 15/02

[52] U.S. Cl. ..... 36/127; 36/134; 36/59 R; 36/59 C

[58] Field of Search ..... 36/127, 134, 67 D, 36/67 R, 59 R, 59 C

[56] References Cited

U.S. PATENT DOCUMENTS

| | | | |
|---|---|---|---|
| 39,575 | 8/1863 | Hyatt et al. . | |
| 180,578 | 8/1876 | Gunsalus . | |
| D. 288,262 | 2/1987 | Yokoishi | D2/317 |
| D. 320,882 | 10/1991 | Collins | D2/314 |
| D. 327,975 | 7/1992 | Saito et al. | D2/314 |
| D. 341,479 | 11/1993 | Saito et al. | D2/314 |
| D. 341,480 | 11/1993 | Saito et al. | D2/317 |
| D. 341,704 | 11/1993 | Saito et al. | D2/962 |
| D. 341,705 | 11/1993 | Saito et al. | D2/962 |
| D. 341,938 | 12/1993 | Saito et al. | D2/962 |
| D. 342,151 | 12/1993 | Saito et al. | D2/962 |
| D. 342,152 | 12/1993 | Saito et al. | D2/962 |
| D. 342,373 | 12/1993 | Saito et al. | D2/962 |

(List continued on next page.)

FOREIGN PATENT DOCUMENTS

| | | |
|---|---|---|
| 0 153 136 | 8/1985 | European Pat. Off. . |
| 0 342 232 | 11/1989 | European Pat. Off. . |
| 0 524 861 | 1/1993 | European Pat. Off. . |
| 493748 | 8/1919 | France . |
| 807754 | 1/1937 | France . |
| 185659 | 6/1907 | Germany . |
| 156642 | 7/1939 | Germany . |
| 2529027 | 1/1977 | Germany . |
| 2540426 | 3/1977 | Germany . |
| 3438060 | 6/1985 | Germany . |
| 4316650 | 11/1993 | Germany . |
| 467815 | 12/1951 | Italy . |
| 762928 | 5/1989 | Japan . |
| 7-209 | 1/1995 | Japan . |
| 6877 | 2/1896 | United Kingdom . |
| 2814 | 2/1914 | United Kingdom . |
| 401979 | 11/1933 | United Kingdom . |
| 1 263 960 | 2/1972 | United Kingdom . |
| 1378461 | 12/1974 | United Kingdom . |
| 1434282 | 5/1976 | United Kingdom . |
| 2 053 658 | 2/1981 | United Kingdom . |
| 2223394 | 4/1990 | United Kingdom . |
| 2248762 | 4/1992 | United Kingdom . |
| 2266223 | 10/1993 | United Kingdom . |
| 91/03960 | 4/1991 | WIPO . |

*Primary Examiner*—Ted Kavanaugh
*Attorney, Agent, or Firm*—Fish & Neave; Jeffrey H. Ingerman

[57] ABSTRACT

A cleat for providing traction in golf shoes (and shoes for other turf sports) that does not adversely affect turf, but provides a desired level of traction under as many different conditions as possible, and is resistant to being worn down on hard surfaces. The cleat has a flange with an attachment stud for attaching to a receptacle in a shoe sole, a plurality of traction protrusions on the flange to engage grass blades to provide traction without damaging turf, and a bearing portion that bears the wearer's weight, particularly when the wearer walks on a hard surface. The protrusions are thereby less affected by the abrading effects of the hard surface, and last longer before they are worn to the point that they are no longer able to provide traction.

56 Claims, 10 Drawing Sheets

U.S. PATENT DOCUMENTS

| | | | |
|---|---|---|---|
| D. 385,988 | 11/1997 | McMullin | D2/962 |
| D. 387,548 | 12/1997 | McMullin | D2/962 |
| D. 389,299 | 1/1998 | McMullin | D2/962 |
| 416,861 | 12/1889 | Scafe . | |
| 485,459 | 11/1892 | Crocker . | |
| 962,719 | 6/1910 | Pratt . | |
| 982,278 | 1/1911 | Kline . | |
| 1,093,358 | 4/1914 | Schroeder . | |
| 1,243,209 | 10/1917 | Park . | |
| 1,304,616 | 5/1919 | Smith . | |
| 1,355,827 | 10/1920 | Finneran . | |
| 1,422,716 | 7/1922 | Jones . | |
| 1,749,351 | 4/1930 | McQueen . | |
| 1,876,195 | 9/1932 | Youmans . | |
| 2,258,805 | 10/1941 | Phillips | 36/59 |
| 2,336,632 | 12/1943 | Park | 36/59 |
| 2,491,596 | 12/1949 | Zaleski et al. | 36/59 |
| 2,745,197 | 5/1956 | Holt | 36/2.5 |
| 2,803,070 | 8/1957 | Passidomo et al. | 36/59 |
| 2,844,833 | 7/1958 | Odermatt | 12/146 |
| 2,895,235 | 7/1959 | Melchiona | 36/59 |
| 3,487,563 | 1/1970 | Austin | 36/67 |
| 3,512,275 | 5/1970 | Leavitt | 36/59 |
| 3,559,310 | 2/1971 | Kiela | 36/7.3 |
| 3,561,140 | 2/1971 | Ludwig | 36/59 |
| 3,583,082 | 6/1971 | Jordan, Jr. | 36/59 |
| 3,583,083 | 6/1971 | Drew | 36/62 |
| 3,656,245 | 4/1972 | Wilson | 36/67 D |
| 3,672,077 | 6/1972 | Coles | 36/2.5 T |
| 3,747,238 | 7/1973 | Jankauskas | 36/61 |
| 3,818,617 | 6/1974 | Dassler et al. | 36/32 R |
| 3,859,739 | 1/1975 | Dassler | 36/67 D |
| 3,890,725 | 6/1975 | Lea et al. | 36/11.5 |
| 4,004,356 | 1/1977 | Green | 36/134 |
| 4,014,114 | 3/1977 | Jordan et al. | 36/67 D |
| 4,141,158 | 2/1979 | Benseler et al. | 36/32 R |
| 4,180,923 | 1/1980 | Dassler | 36/32 R |
| 4,205,466 | 6/1980 | Collins | 36/67 D |
| 4,233,759 | 11/1980 | Bente et al. | 36/59 R |
| 4,294,024 | 10/1981 | Nab | 36/113 |
| 4,299,038 | 11/1981 | Epple | 36/67 D |
| 4,309,376 | 1/1982 | Ueno et al. | 264/241 |
| 4,330,950 | 5/1982 | Reddien | 36/127 |
| 4,366,632 | 1/1983 | Bente | 36/67 D |
| 4,392,312 | 7/1983 | Crowley et al. | 36/67 R |
| 4,492,047 | 1/1985 | Arff | 36/134 |
| 4,521,979 | 6/1985 | Blaser | 36/29 |
| 4,527,345 | 7/1985 | Lopez Lopez | 36/127 |
| 4,571,852 | 2/1986 | Lamarche et al. | 36/32 R |
| 4,587,748 | 5/1986 | Collins | 36/127 |
| 4,633,600 | 1/1987 | Dassler et al. | 36/134 |
| 4,689,901 | 9/1987 | Ihlenburg | 36/126 |
| 4,723,366 | 2/1988 | Hagger | 36/134 |
| 4,727,661 | 3/1988 | Kuhn | 36/100 |
| 4,777,738 | 10/1988 | Giese et al. | 36/32 R |
| 4,782,604 | 11/1988 | Wen-Shown | 36/127 |
| 4,833,796 | 5/1989 | Flemming | 36/134 |
| 4,837,949 | 6/1989 | Dufour | 36/127 |
| 4,885,851 | 12/1989 | Peterson | 36/127 |
| 5,029,405 | 7/1991 | DeHaitre | 36/134 |
| 5,033,211 | 7/1991 | Latraverse et al. | 36/134 |
| 5,070,631 | 12/1991 | Fenton | 36/127 |
| 5,077,916 | 1/1992 | Beneteau | 36/114 |
| 5,259,129 | 11/1993 | Deacon et al. | 36/127 |
| 5,367,793 | 11/1994 | Deacon et al. | 36/127 |
| 5,483,760 | 1/1996 | Kataoka et al. | 36/134 |
| 5,533,282 | 7/1996 | Kataoka et al. | 36/129 |
| 5,623,774 | 4/1997 | Abbey | 36/134 |
| 5,794,367 | 8/1998 | Carroll | 36/134 |

GOLF CLEAT

CROSS REFERENCE TO RELATED APPLICATIONS

This is a continuation of U.S. patent application Ser. No. 08/823,901, filed Mar. 25, 1997, now abandoned, which claimed the benefit of U.S. Provisional Application No. 60/034,328, filed Dec. 20, 1996.

BACKGROUND OF THE INVENTION

This invention relates to cleats for use with shoes worn on turf, and particularly to a golf cleat that provides enhanced traction without adversely affecting the turf, and at the same time is resistant to wear when worn on other surfaces.

The need for improved traction on turf surfaces is well known. Specialized shoes for many different sports—e.g., baseball, football, soccer and golf, among others—have structure provided on their soles to enhance traction. Taking golf as a representative example throughout the remainder of this specification, it has long been known to provide golf shoes with relatively large metal spikes for traction.

For almost as long as they have been in use, golf spikes (and similar structures provided on athletic shoes for other turf sports) have also been known to adversely affect the turf of golf courses (or other playing surfaces), and particularly putting greens. The large spikes tear into the putting green surface, particularly when a golfer drags his or her feet as many do, leaving "spike marks" that disrupt the carefully manicured surface and adversely affect the trajectories of putted golf balls. So well known are spike marks in golf that the rules of the game have been adapted to account for their presence (the rules prohibit repairing spike marks before putting). In addition to affecting players' putting, spike marks also affect groundskeepers, who after a day of play by numerous spike-wearing golfers have to spend hours repairing the various putting greens on their golf courses.

In addition to the annoyance to players and groundskeepers caused by the marks that they leave, traditional golf shoe spikes also affect the health of grass all over the golf course, not only on greens. First, the spikes penetrate a significant distance into the ground, frequently damaging a portion of the grass plant above the roots, known as the "crown." Damage to the crown often kills the plant. Second, the spikes pick up seeds of undesirable plants—including weeds and grasses (e.g., *Poa annua*)—and inoculate those seeds into the greens, causing growth of undesirable plants.

Traditional metal golf spikes are also damaging to the floor surfaces of golf clubhouses, and may actually exacerbate slipping on certain clubhouse floor surfaces such as marble. Traditional metal golf spikes even cause damage to paved outdoor walkways.

One known solution to the problems caused by traditional golf spikes is shown in commonly-assigned U.S. Pat. Nos. 5,259,129 and 5,367,793, which are hereby incorporated by reference in their entirety. Those patents show a golf cleat that attaches to the same golf shoe fittings designed for traditional spikes. The cleat is preferably made from a plastic material having a preferably convex lower surface bearing a plurality of ribs that distribute the golfer's weight to produce a plurality of gripping forces—which are mainly frictional—in a plurality of directions, without puncturing the turf, thereby reducing the adverse affects described above.

Cleats such as those described in the aforementioned patents recently have become increasingly popular. Other nonmetallic alternatives to metal spikes, having different types of ribs or protrusions, have also come into use.

One drawback of nonmetallic spike alternatives has been that, because the cleats are worn not only on the turf portions of the golf course, but also on paved walkways and other hard surfaces, the ribs or protrusions that provide the traction on turf are gradually abraded away by the hard surfaces, much faster than they would be if worn exclusively while walking on turf. As a result, the ability of the cleat to provide traction is reduced or destroyed, and the cleat must be replaced sooner than if it were worn exclusively on turf.

It would be desirable to be able to provide a cleat for providing traction on turf that would not lose its traction providing ability so rapidly when also worn on hard surfaces.

SUMMARY OF THE INVENTION

It is an object of the present invention to provide a cleat for providing traction on turf that would not lose its traction providing ability so rapidly when also worn on hard surfaces.

In accordance with this invention, there is provided a removable cleat for use with an athletic shoe for providing to a user, or wearer, traction on a turf surface while withstanding abrasion on a surface other than turf. The athletic shoe with which the cleat is used has a sole, and the sole has a plurality of sole attachment means for attachment of removable cleats. The removable cleat includes (a) a flange having an upper surface, an opposing lower surface and an edge, (b) flange attachment means extending from the upper surface of the flange for removably attaching the cleat to one of the sole attachment means of the sole of the shoe, (c) a plurality of traction protrusions arranged on the opposing lower surface such that a clear area of the flange exists between the traction protrusions, each of the traction protrusions having a height sufficient to engage blades of grass in the turf to provide traction substantially without puncturing the turf, and (d) a bearing portion on the opposing lower surface of the flange in the clear area for bearing the weight of the user.

An athletic shoe incorporating such cleats is also provided.

By "substantially without puncturing the turf" is meant that the protrusions extend into and engage the grass blades of the turf, but do not penetrate into the ground or, if they do penetrate into the ground on certain types of turf surfaces (such as closely cropped greens), penetrate into the ground only a negligible amount insufficient to significantly damage the grass plant. What is important is that the crown of the grass plant not be damaged.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which.

DETAILED DESCRIPTION OF THE INVENTION

Figure 1:
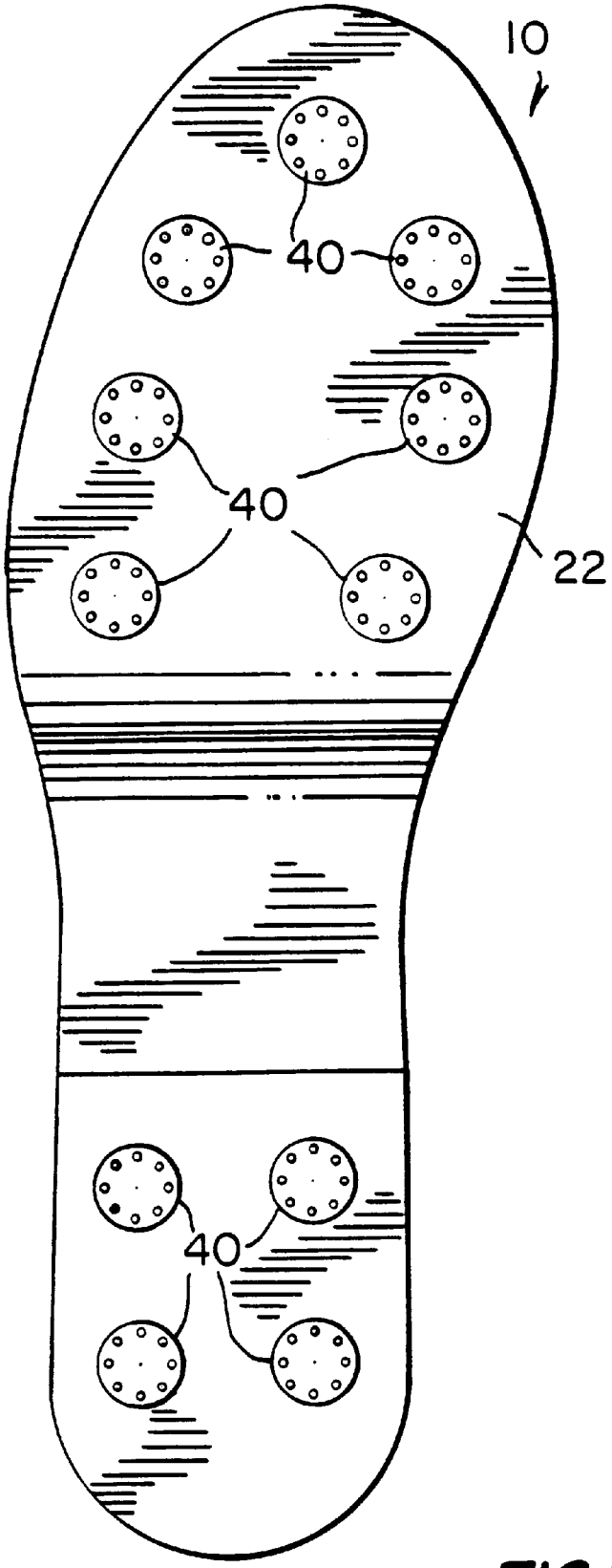
FIG. 1 is a plan view of the underside of an athletic shoe incorporating a first preferred embodiment of the present invention.

In accordance with the present invention, traction is provided for athletic activities on turf surfaces by providing an athletic shoe having cleats with a plurality of relatively small protrusions, and having a separate load-bearing portion that does not provide traction, but bears the wearer's weight both on turf surfaces, and, more importantly, when the wearer walks on hard surfaces. The traction protrusions are preferably located around the edge of the cleat, with the load-bearing portion in the interior portion of the cleat. The load-bearing portion preferably has a configuration that also serves to prevent the area between the traction protrusions from filling with turf debris, which otherwise may reduce traction.

In one preferred embodiment, for example, each cleat is substantially circular and has between about four and about ten—preferably about eight—traction protrusions. Thus, in place of ten or twelve relatively large metal golf spikes on a golf shoe, there would be a large number—(e.g., about 40 to about 120, and preferably about 80 to about 96)—of relatively small traction protrusions. The traction protrusions of the present invention provide traction by physical interengagement with the grass blades of the turf surface, but they have a low profile so that they do not penetrate the ground or, if they do penetrate, they penetrate only a negligible amount. Therefore, they provide better traction than the cleats described in the aforementioned commonly-assigned patents, but they do not cause the damage associated with traditional large metal spikes, because they do not penetrate the crowns of the grass plants. Moreover, this preferred embodiment preferably has a domed portion in the center, within the circular area bounded by the protrusions. The domed portion has a height low enough to avoid interfering with the ability of the protrusions to provide traction on turf, but high enough that on a hard surface it engages the surface, and spares the protrusions from bearing the wearer's weight against the hard surface. The domed portion bears substantially all of the wearer's weight, minimizing abrading frictional forces between the protrusions and the surface. The domed portion preferably also bears the wearer's weight on turf surfaces, so that the protrusions can provide traction substantially without bearing any of the wearer's weight, so that they substantially do not damage the turf.

The domed portion could be about the same height as the protrusions. Alternatively, the height of the domed portion could be less than that of the traction protrusions, but because of the resilience of the cleat material, the traction protrusions preferably would bend out of the way on a hard surface, so that the domed portion still bears primarily all of the load. The height of the domed portion is preferably not less than 50% of the height of the traction protrusions.

The domed portion could be a solid dome, or it could have portions removed so that the domed surface is no longer smooth but the peak of the dome is still in place to bear the load. The portions could be removed along radial lines, along chords, along arcs or from any other area.

Alternatively, the load bearing portion could be a structure other than a dome. However, the dome configuration is preferred because it tends to push turf debris outward out of the cleat. Such debris might otherwise accumulate in the area between the traction protrusions, to the point that they fill in that space and create a smooth surface, eliminating the ability to provide traction.

As set forth above, the entire cleat, including the flange that carries the protrusions and the load-bearing portion, as well as the attachment stud that screws into a receptacle on a golf shoe, is molded from a resilient polymeric material, preferably a resilient elastomeric material, such as polyurethane. Alternatively, however, the cleat could be a co-molding of two or more different materials. For example, the load-bearing portion might be molded from a harder, somewhat more abrasion-resistant material than the traction protrusions, such as an aramid-reinforced polymer (e.g., aramid-reinforced nylon). In addition, the attachment stud could be metallic, with the flange, dome and protrusions molded (or co-molded as discussed) onto the metallic stud.

The traction protrusion of the invention preferably is a truncated cone. To achieve sufficient column stiffness, the width of the base of each traction protrusion is preferably about the same as the height of the traction protrusion. The width of each traction protrusion preferably varies as one moves along its height, most preferably decreasing continuously from the base toward the tip. The traction protrusion preferably should not come to a point, because a pointed traction protrusion would wear faster than one with a blunt tip. For that reason, as well as to avoid tearing the grass blades, and to avoid injury if a wearer were to accidentally brush his skin or that of another with the tips of the traction protrusions, it is also particularly preferred, though not essential, that the traction protrusions not be made of metal.

However, it is within the present invention for the traction protrusions to have any shape. They can be symmetrical or asymmetrical about their axes. They can have sharp or blunt tips, which may be flat, convex or concave. Each traction protrusion preferably extends from the flange at least about 0.07 inch (about 1.78 mm), but no more than about 0.138 inch (about 3.5 mm), and preferably about 0.130 inch (about 3.3 mm) with the total height of the cleat, from the top of the flange (where it contacts the shoe) to the most downwardly extending portion of any protrusion or load-bearing portion, of between about 0.07 inch (about 1.78 mm) and about 0.25 inch (about 6.35 mm), and preferably about 0.21 inch (about 5.33 mm).

The traction protrusions could also be ribs having triangular, arcuate or rectangular cross sections. If the flange is circular, the ribs could lie on radii or chords of the circle, or they could be arranged on the flange along circles on the flange.

The edge of the flange which touches the shoe preferably defines a circle in a plane that coincides with the shoe sole when the cleat is mounted on a shoe, although it could define any regular or irregular shape so long as the entire edge is in one plane. Each traction protrusion has an axis, which extends from the flange at an angle, measured relative to a normal to the plane defined by the edge, between about 5° inward from the edge to about 15° outward from the edge. Preferably, the axis of each protrusion is parallel to the normal (i.e., the angle is 0°).

The traction protrusions are preferably mounted at the edge of the flange, but may be mounted inward of the edge, particularly if the flange is not circular. Regardless of the shape of the flange, each traction protrusion preferably has a thin gusset connected to the flange on the side of the protrusion away from the edge. The gusset, which preferably is thin enough to have no effect on traction, or on the turf, acts as a stabilizer, pulling the protrusion upright after it has been deflected when the wearer is walking on a hard surface.

The invention will now be described with reference to the drawings.

Figure 2:
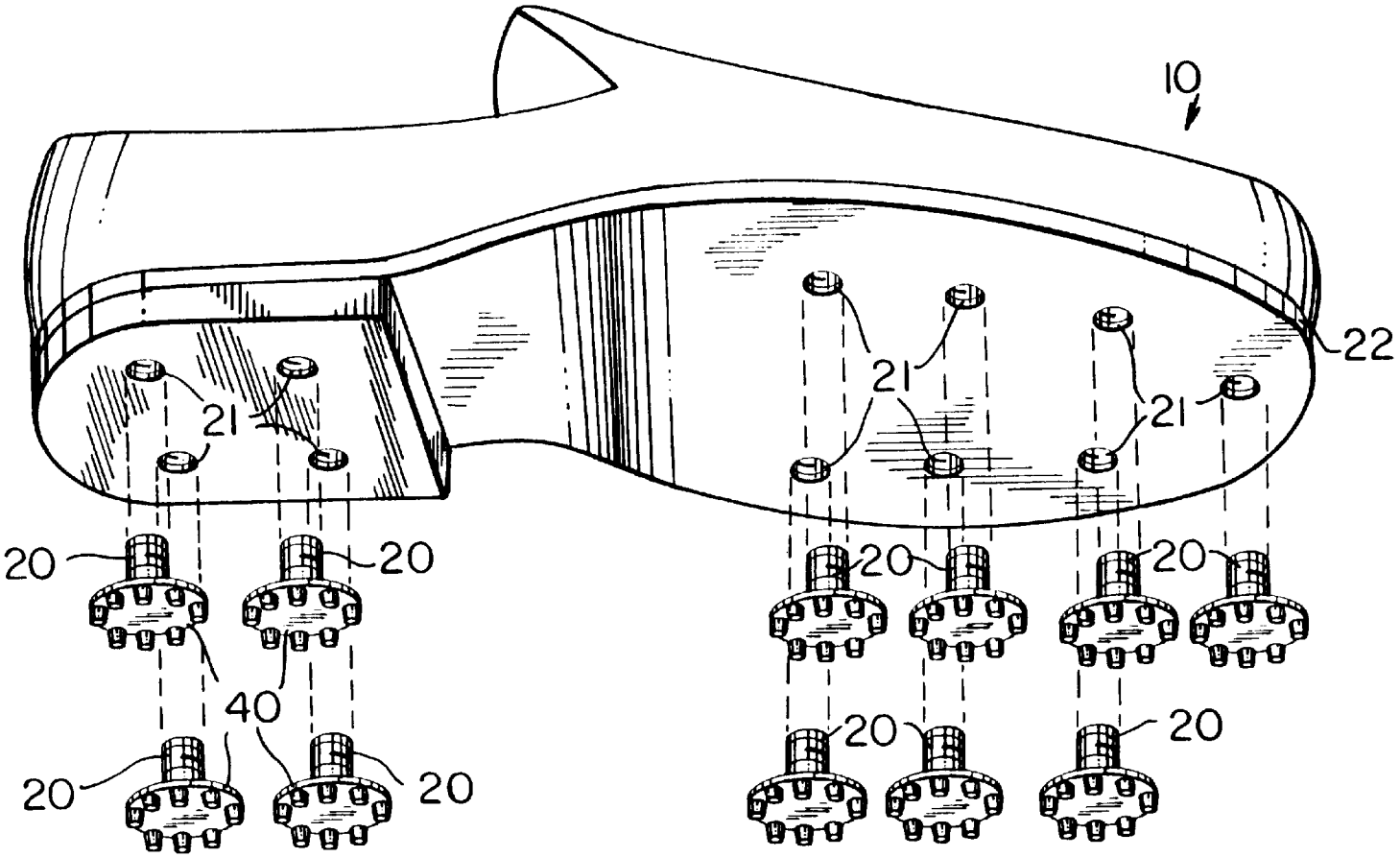
FIG. 2 is an exploded bottom perspective view of the athletic shoe of FIG. 1.
Figure 3:
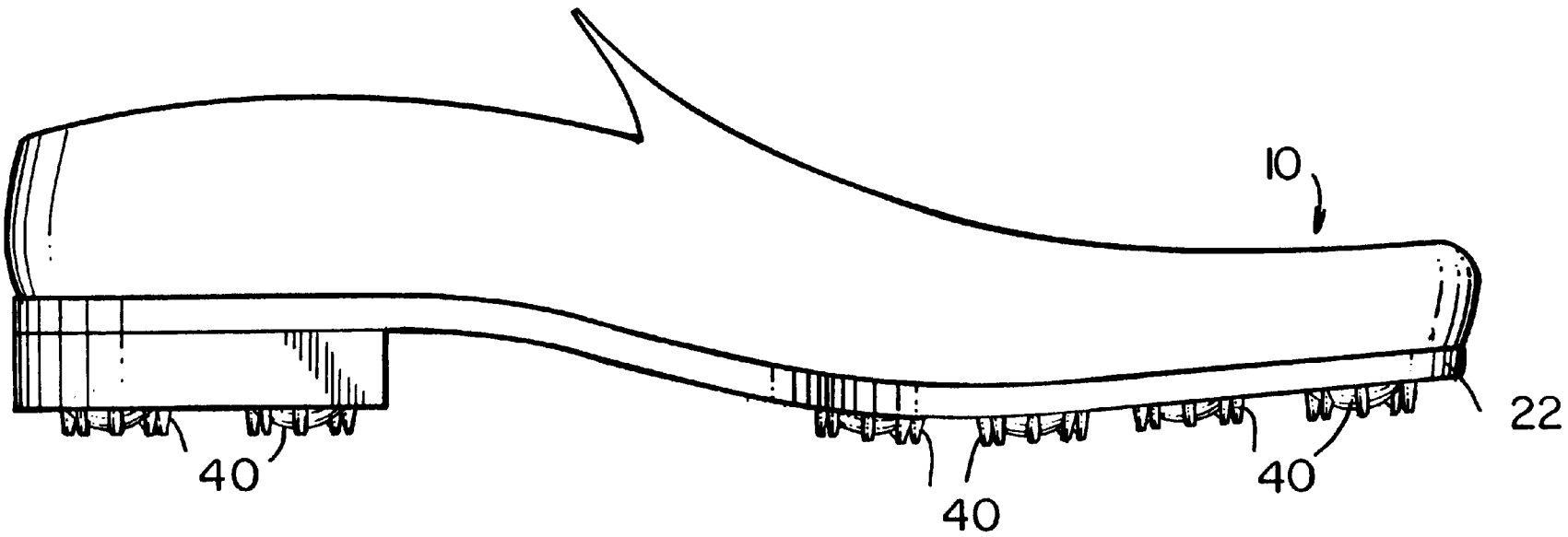
FIG. 3 is a side elevational view of an athletic shoe incorporating the first preferred embodiment of the present invention.

FIGS. 1–3 show a shoe 10 bearing a plurality of cleats 40 according to the present invention. As shown, there are preferably eleven cleats 40, although any other number may be provided. Each cleat 40 preferably has an attachment stud 20, which preferably is threaded for attachment to shoe 10 via one of threaded sockets 21, preferably provided for this purpose. Of course, other types of attachment could be provided.

Figure 4:
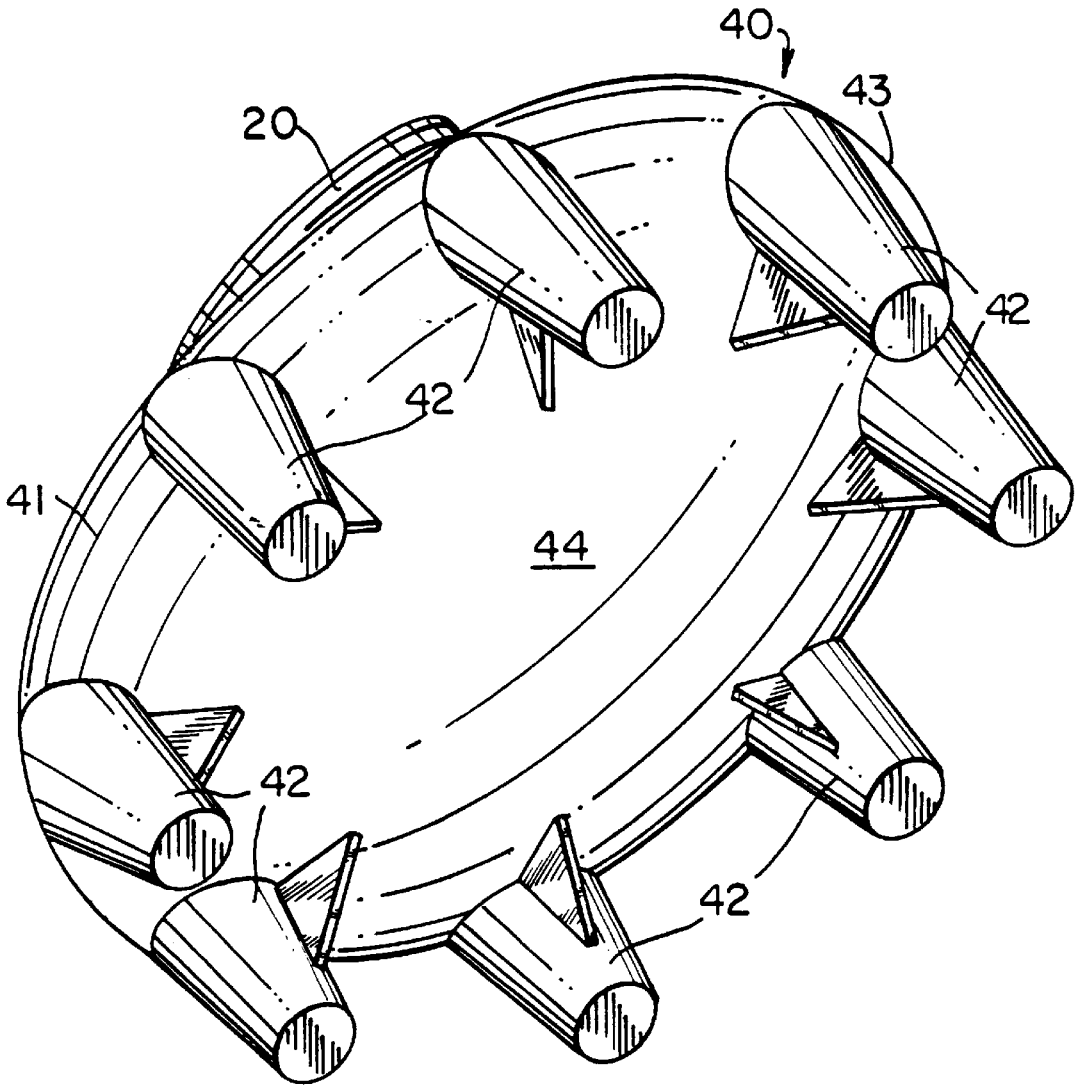
FIG. 4 is a bottom perspective view of a cleat according to the first preferred embodiment of the present invention.
Figure 5:
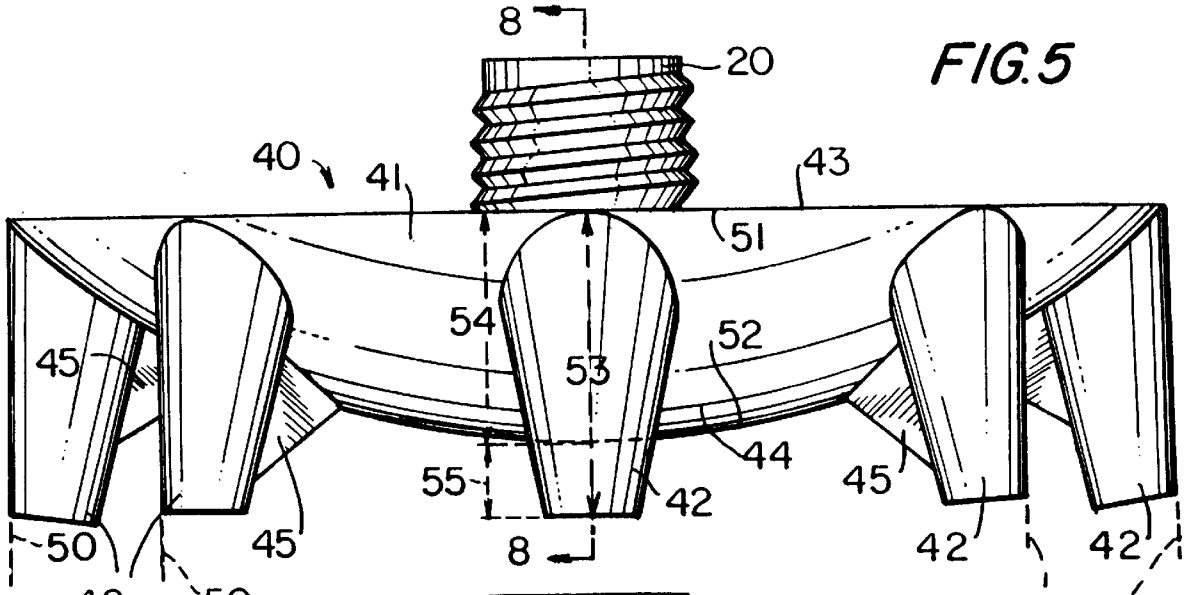
FIG. 5 is a side elevational view of a cleat according to the first preferred embodiment of the present invention.
Figure 8:
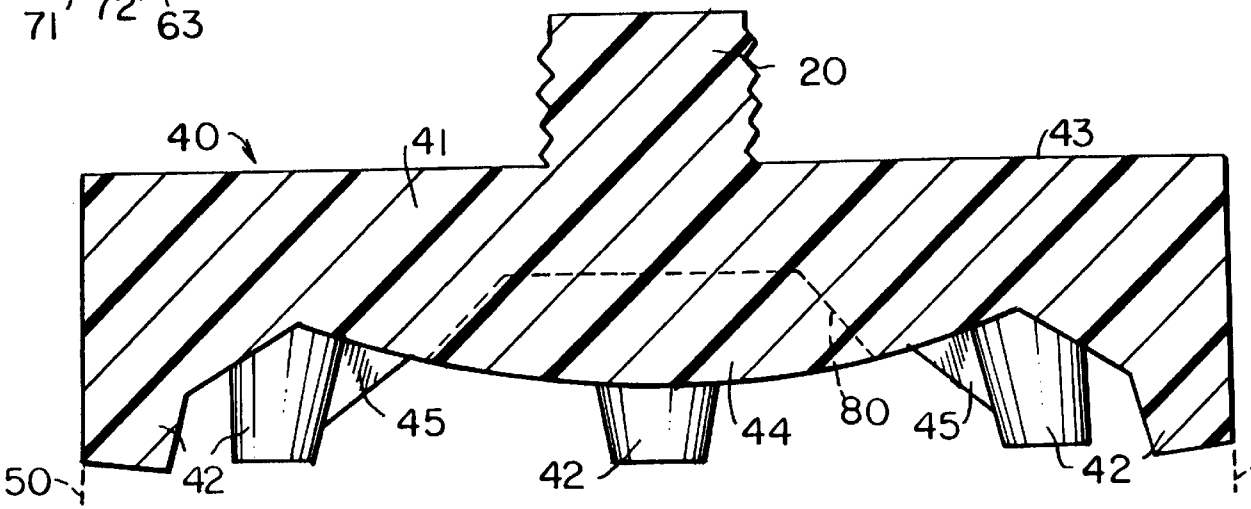
FIG. 8 is a vertical cross-sectional view of the cleat of FIGS. 4 and 5, taken from line 8—8 of FIG. 5.

Cleat 40 is shown in more detail in FIGS. 4, 5 and 8. In addition to stud 20, discussed above, each cleat 40 preferably has a preferably circular flange 41 bearing a plurality of traction protrusions 42 of the type described above, which preferably are truncated cones having substantially flat tips. Traction protrusions 42 provide traction on turf preferably by interengaging with the individual grass blades without penetrating or puncturing the crown of any individual grass plant of the turf, and without penetrating or puncturing the soil.

Figure 6:
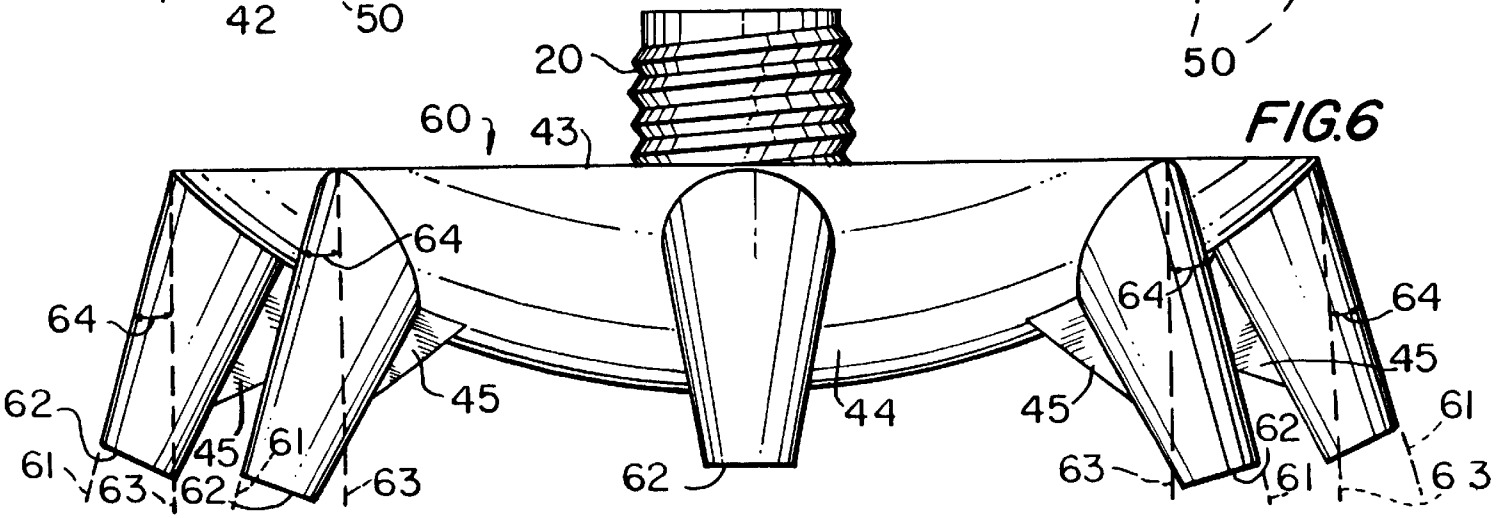
FIG. 6 is a side elevational view of a cleat according to a second preferred embodiment of the present invention.
Figure 7:
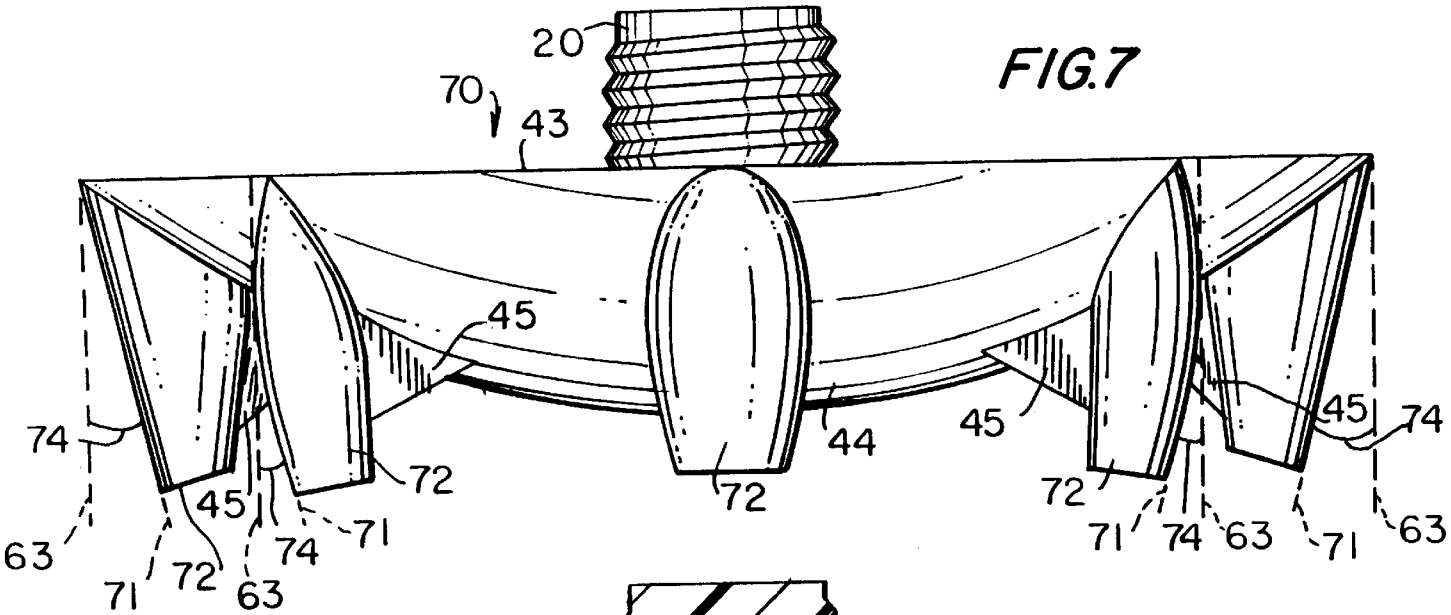
FIG. 7 is a side elevational view of a cleat according to a third preferred embodiment of the present invention.

Flange 41 preferably has an edge 43 designed to fit snugly against sole 22 of shoe 10, and edge 43 thus preferably lies completely within a single plane. Each traction protrusion 42 preferably has a preferred axis, and that preferred axis preferably is perpendicular to the plane defined by edge 43. The preferred axis of each traction protrusion 42 is shown as dashed line 50 in FIGS. 5 and 8. Alternatively, as shown in the preferred embodiment of a cleat 60 FIG. 6, the preferred axis 61 of each traction protrusion 62 could extend outward from a normal 63 to the plane of edge 43 by an angle 64 of up to about 15° as shown. As a further alternative, in the preferred embodiment of a cleat 70 of FIG. 7, the preferred axis 71 of each traction protrusion 72 could extend inward from normal 63 to the plane of edge 43 by an angle 74 of up to about 5° as shown.

Each of embodiments 40, 60 and 70 preferably has a raised central portion 44 for bearing the wearer's weight as discussed above. Preferably, raised portion 44 is dome-shaped as discussed above to push aside turf debris and prevent clogging. Any other sloped configuration of raised portion 44 could be used to serve that purpose.

As discussed above, on turf surfaces, portion 44 would preferably bear substantially all of the wearer's weight, freeing protrusions 42, 62, 72 to provide traction by interengaging with the grass blades, substantially without transmitting any of the wearer's weight to the turf, so that they cause substantially no damage to the turf. On hard surfaces, such as paved walkways and clubhouse floors, the vast majority of the wearer's weight would be borne by portion 44. Thus, any abrasion of cleat 40, 60, 70 caused by the hard surface would abrade substantially only portion 44. Whatever weight is transmitted by protrusions 42, 62, 72, preferably would result, instead of in abrasion of protrusions 42, 62, 72, in the bending outward (or possibly inward, especially in cleat 70) of the traction protrusions, allowing portion 44 to bear the weight.

Cleat 40, 60, 70 preferably is made from a resilient polymeric material, particularly a resilient elastomeric material, such as polyurethane. Alternatively, the area of portion 44 within dashed line 80 (FIG. 8) could be co-molded from a harder or more abrasion-resistant material such as an aramid-reinforced polymer, as discussed below in connection with FIGS. 9 and 10. The resilient nature of cleat 40, 60, 70 allows traction protrusions 42, 62, 72 to bend out of the way on hard surfaces as discussed. To better assure that protrusions 42, 62, 72 will spring back into place when removed from the hard surface and/or relieved of the wearer's weight, a gusset 45 preferably is provided between each protrusion 42, 62, 73 and flange 41, preferably in a direction away from edge 43. Gusset 45 preferably is thin enough to prevent damage to the turf when protrusions 42, 62, 72 engage the grass blades, and preferably has a thickness of about 0.02 inch (about 0.51 mm).

Figure 9:
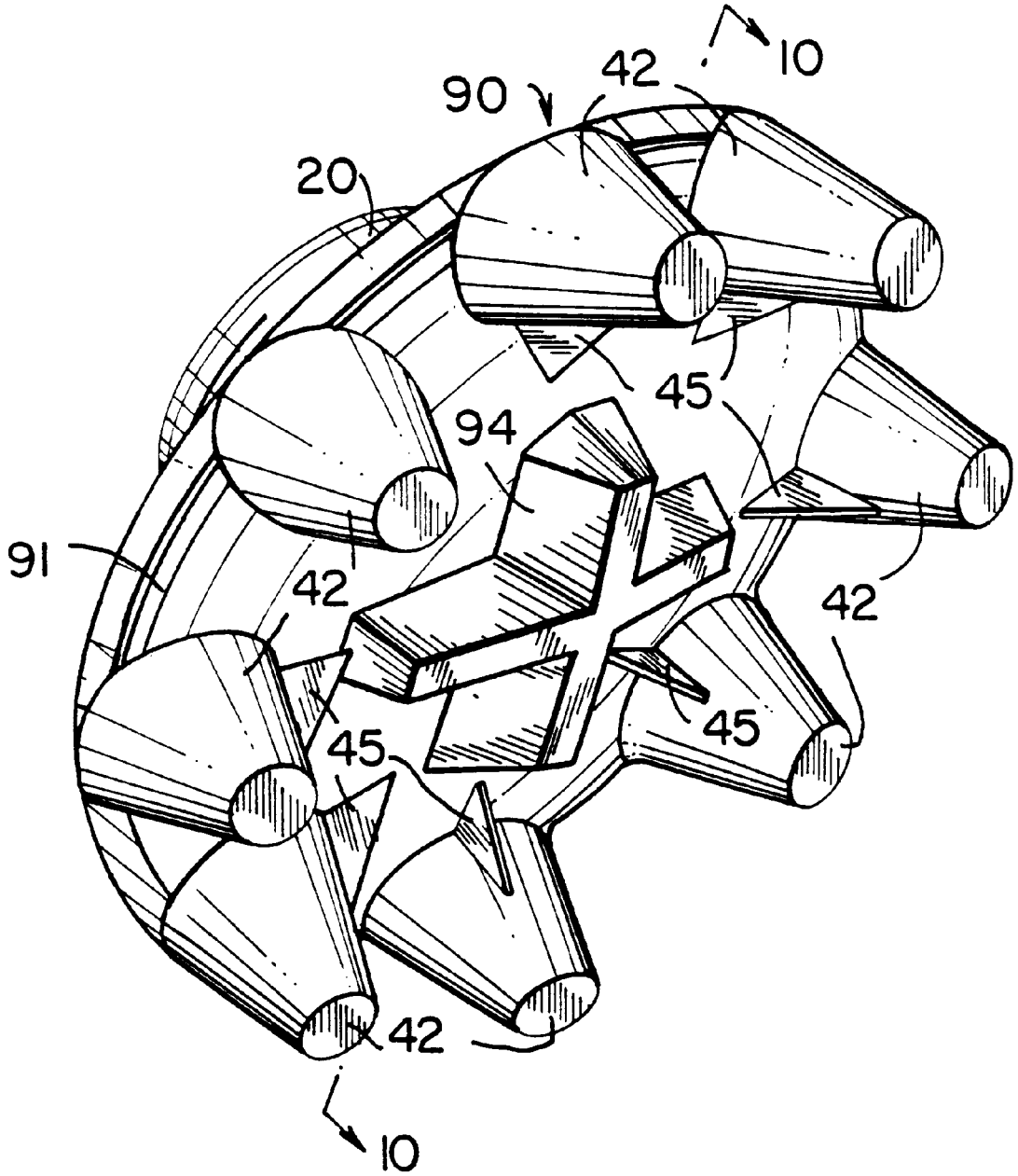
FIG. 9 is a bottom perspective view of a cleat according to a fourth preferred embodiment of the present invention.
Figure 10:
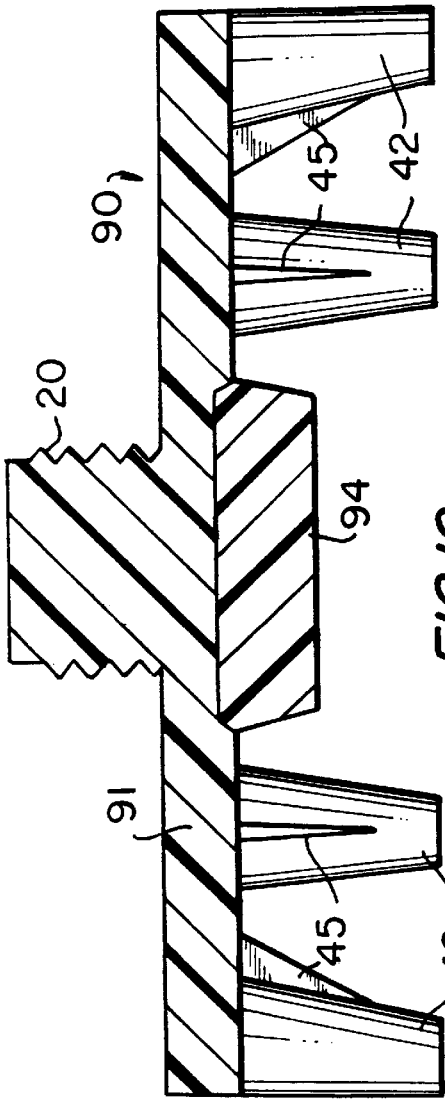
FIG. 10 is a vertical cross-sectional view of the cleat of FIG. 9, taken from line 10—10 of FIG. 9.

A further alternative embodiment 90 is shown in FIGS. 9 and 10. In this embodiment, the central raised portion 94 in not a dome, but another shape such as a cross. Thus, flange 91 preferably is substantially flat. Moreover, cross 94 as shown in FIG. 10 preferably is a co-molding of the harder material, such as an aramid-reinforced polymer, discussed above. Of course, cross 94 could be made of the same material as the remainder of cleat 90.

Figure 11:
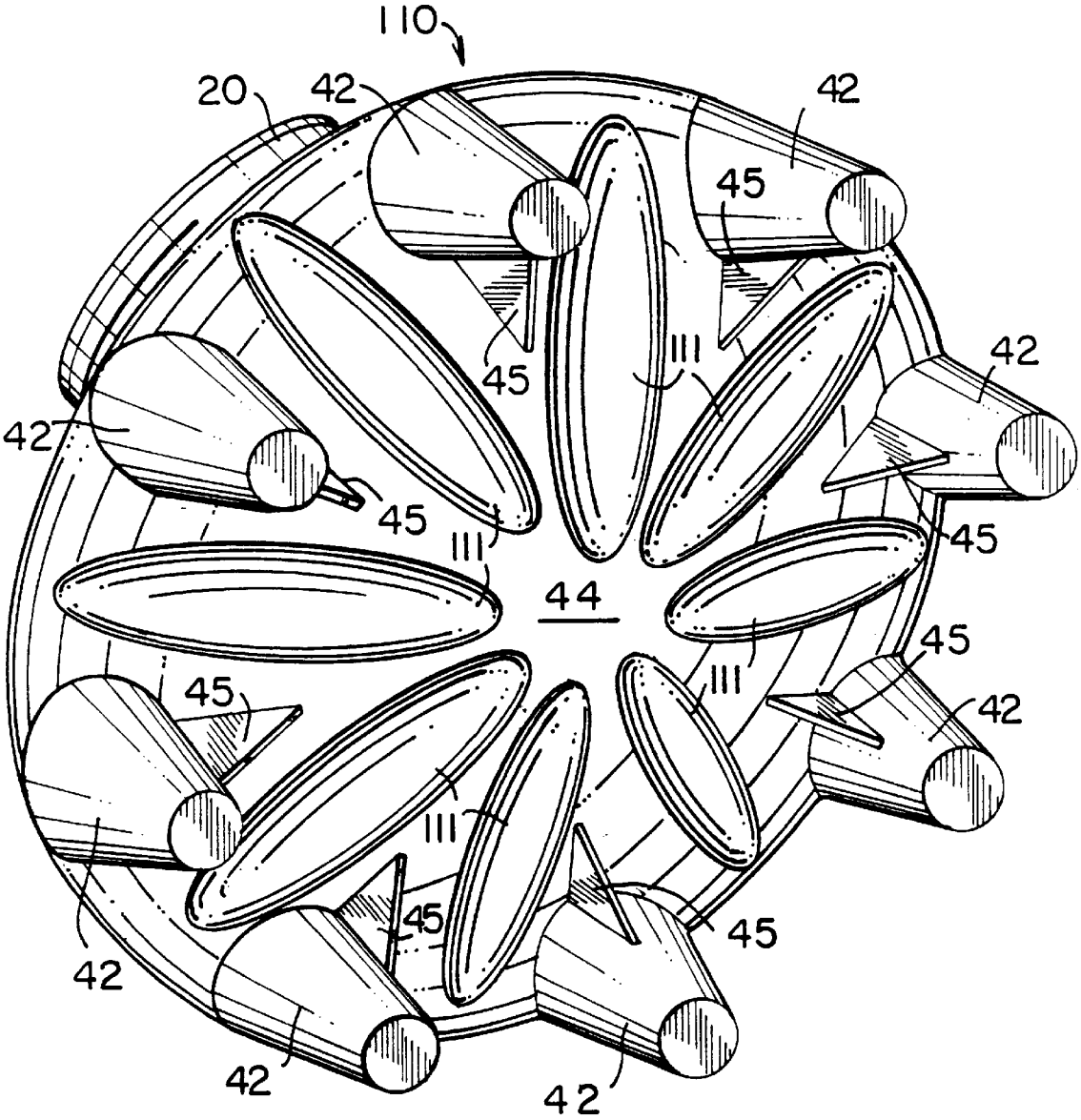
FIG. 11 is a bottom perspective view of a cleat according to a fifth preferred embodiment of the present invention.

A still further alternative embodiment 110, shown in FIG. 11, is substantially identical to embodiment 40, except that material is removed from raised dome portion 44 in areas 111. Although areas 111 are shown as being arranged radially and feathering smoothly into portion 44, they could be arranged as chords or arcs or in any other configuration, and they could have more abrupt edges. Provision of areas 111 allow cleat 110 to be made with less material, and also provide for the channeling of moisture when they are arranged radially as shown.

A further advantage of cleats according to the present invention is illustrated in FIG. 5. As seen there, upper surface 51 preferably meets lower surface 52 at edge 43. Each traction protrusion 42, measured at edge 43, preferably extends a first distance 53 from upper surface 52. That first distance 53, at the outer edge of cleat 40, is the effective traction dimension presented to grass blades during lateral motion, such as during a golf swing. Weight bearing portion 44, on the other hand, extends a distance 54, less than distance 53, from upper surface 51. Because portion 44 also bears against the turf, the effective height of traction protrusions 42 for the purposes of penetration into the turf is limited to a penetration height 55 substantially equal to the difference between distance 53 and distance 54.

FIGS. 12–16 show alternative cleat configurations within the present invention. For example, while the flange as shown is circular in FIGS. 1–15, FIG. 16 shows a cleat 160 with a square flange 161. Other rectangular configurations could also be used, as could other polygons or irregular configurations.

Figure 13:
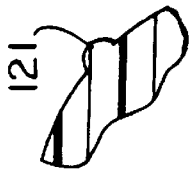
FIG. 13 is a partial vertical cross-sectional view of the cleat of FIG. 12, taken from line 13—13 of FIG. 12.
Figure 15:
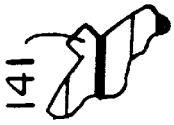
FIG. 15 is a partial vertical cross-sectional view of the cleat of FIG. 14, taken from line 15—15 of FIG. 14.
Figure 14:
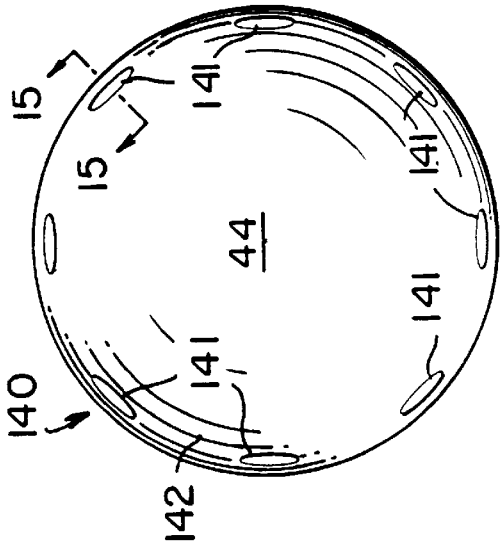
FIG. 14 is a bottom view of a cleat according to a seventh preferred embodiment of the present invention.
Figure 12:
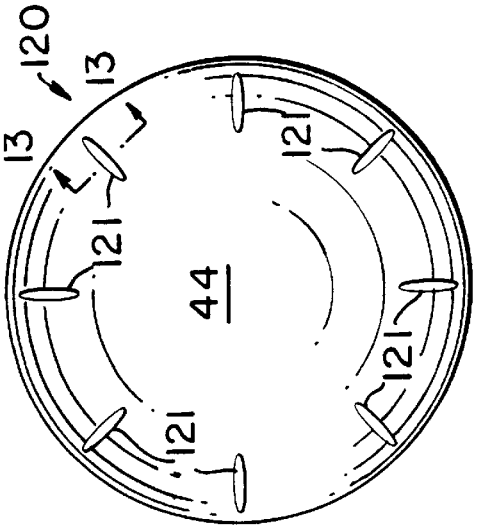
FIG. 12 is a bottom view of a cleat according to a sixth preferred embodiment of the present invention.
Figure 16:
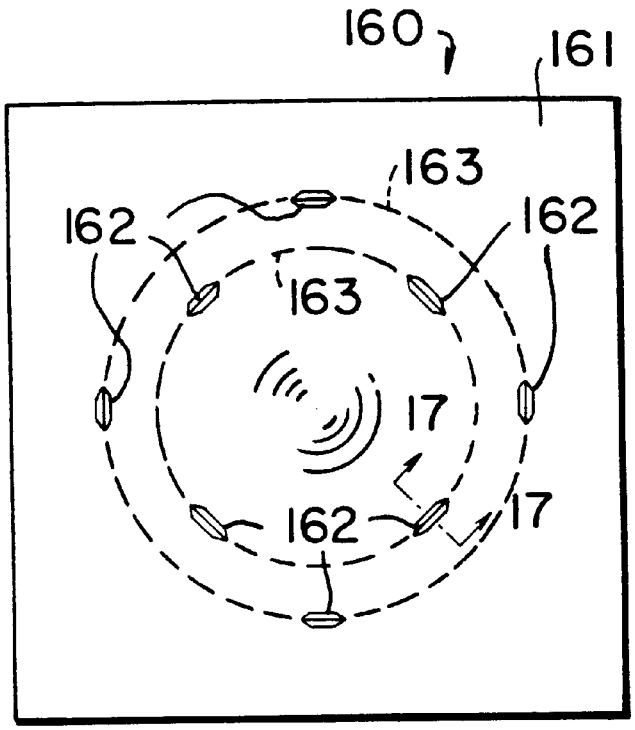
FIG. 16 is a bottom view of a cleat according to a eighth preferred embodiment of the present invention.

Similarly, while truncated cones have been shown as the traction protrusions in FIGS. 1–11, they could also be ribs—i.e., low-profile, elongated elements—as shown in FIGS. 12–16. As seen in FIG. 12, ribs 121 of cleat 120 are arranged radially. As seen in FIG. 14, ribs 141 of cleat 140 are arranged along chords of flange 142. As seen in FIG. 16, ribs 162 of cleat 160 are arranged along concentric circles 163 on flange 161. Note that ribs 162 could be arranged on a single circle, rather than on two circles as shown in FIG. 16. It should be recognized that chordal ribs 141 of cleat 140 also are arranged along a circle, but ribs 162 are on a square flange 161 on which the concept of a chord does not apply; the same may be true of other polygonal or other shaped flanges (not shown) that could be used. It should also be recognized that while ribs 121, 141, 162 are shown as being straight, they could also be curved; ribs 162 could even have a curvature different from the circles 163 on which they lie.

Figure 17:
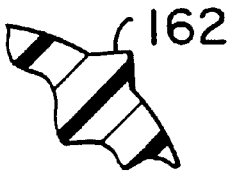
FIG. 17 is a partial vertical cross-sectional view of the cleat of FIG. 16, taken from line 17—17 of FIG. 16.

Finally, the cross-sectional shape of the ribs could be arcuate as shown in FIG. 13, rectangular as shown in FIG. 15, or triangular as shown in FIG. 17, or any other shape. Note that the cross-sectional shapes shown in FIGS. 13, 15, 17 are not limited to use with the respective rib configurations of FIGS. 12, 14, 16. Rather, any rib cross-sectional shape could be used with any rib configuration as may be desired.

Thus it is seen that a cleat for providing traction in golf shoes (and shoes for other turf sports) that does not adversely affect turf, but provides a desired level of traction under as many different conditions as possible, and is resistant to being worn down on hard surfaces, has been provided.

What is claimed is:

1. A removable cleat for use with an athletic shoe for providing to a user traction on a turf surface while withstanding abrasion on a surface other than turf, said athletic shoe having a sole, said sole having a plurality of sole attachment means for attachment of removable cleats, said removable cleat comprising:

(a) a flange having an upper surface, an opposing lower surface and an edge;

(b) flange attachment means extending from said upper surface of said flange for removably attaching said cleat to one of said sole attachment means of said sole of said shoe;

(c) a bearing portion on said opposing lower surface of said flange remote from said edge; and (d) a plurality of traction protrusions arranged on said opposing lower surface solely adjacent said edge, each of said traction protrusions having a height sufficient to engage blades of grass in said turf to provide traction substantially without puncturing said turf, each of said traction protrusions being deflectably resilient, said traction protrusions being located relative to said bearing portion such that said bearing portion substantially bears the weight of said user, substantially without said traction protrusions bearing said weight of said user, both on said turf surface and on said surface other than turf, said traction protrusions deflecting under any weight borne by them; said removable cleat having, when installed in said shoe:

(e) an overall height measured from said upper surface of said flange to a most downwardly extending point of one of (a) said traction protrusions and (b) said bearing portion, said overall height being between about 0.07 inch (about 1.78 mm) and about 0.25 inch (about 6.35 mm).

2. The removable cleat of claim 1 wherein said overall height is about 0.21 inch (about 5.33 mm).

3. The removable cleat of claim 1 wherein:

each of said protrusions has a protrusion height measured from a first end of said protrusion at said flange to a second end of said protrusion remote from said flange; and said protrusion height is between about 0.07 inch (about 1.78 mm) and about 0.138 inch (about 3.5 mm).

4. The removable cleat of claim 3 wherein said protrusion height is about 0.13 inch (about 3.3 mm).

5. The removable cleat of claim 1 wherein said flange and said traction protrusions are molded from a first resilient elastomeric material.

6. The removable cleat of claim 5 wherein said bearing portion is molded with said flange and said traction protrusions from said first resilient elastomeric material.

7. The removable cleat of claim 5 wherein said bearing portion is co-molded with said flange and said traction protrusions from a second polymeric material having abrasion resistance greater said first resilient elastomeric material.

8. The removable cleat of claim 7 wherein said first resilient elastomeric material comprises polyurethane and said second polymeric material comprises an aramid-reinforced polymer.

9. The removable cleat of claim 5 wherein said first resilient elastomeric material comprises polyurethane.

10. The removable cleat of claim 1 wherein said traction protrusions are arranged adjacent said edge.

11. The removable cleat of claim 10 further comprising a gusset extending between each of said traction protrusions and said flange in a direction away from said edge.

12. The removable cleat of claim 1 wherein each of said traction protrusions comprises a rib.

13. The removable cleat of claim 12 wherein:

said flange is circular; and said rib lies on a radius of said flange.

14. The removable cleat of claim 12 wherein:

said flange is circular; and said rib lies on a chord of said flange.

15. The removable cleat of claim 12 wherein:

said ribs lie on at least one circle on said flange; and each said at least one circle is concentric with any other said at least one circle.

16. The removable cleat of claim 12 wherein said rib has an arcuate cross section.

17. The removable cleat of claim 12 wherein said rib has a triangular cross section.

18. The removable cleat of claim 12 wherein said rib has a rectangular cross section.

19. The removable cleat of claim 1 wherein each of said traction protrusions is substantially conical.

20. The removable cleat of claim 1 wherein said bearing portion is a raised portion of said flange.

21. The removable cleat of claim 20 wherein said raised portion comprises a domed portion.

22. The removable cleat of claim 21 wherein said domed portion comprises at least one depressed portion.

23. The removable cleat of claim 1 comprising between about four and about ten of said traction protrusions.

24. The removable cleat of claim 1 further comprising a gusset extending between each of said traction protrusions and said flange in a direction away from said edge.

25. The removable cleat of claim 1 wherein:

said edge of said flange defines a plane; and each of said traction protrusions extends from said opposing lower surface along an axis defining an angle with a normal to said plane of between about 5° inward from said edge and about 15° outward toward said edge.

26. The removable cleat of claim 25 wherein said axis is substantially perpendicular to said plane.

27. An athletic shoe for providing to a user traction on a turf surface while withstanding abrasion on a surface other than turf, said athletic shoe comprising:

a sole;

a plurality of sole attachment means on said sole for attachment of removable cleats; and a plurality of removable cleats, each of said removable cleats comprising:

(a) a flange having an upper surface, an opposing lower surface and an edge, (b) flange attachment means extending from said upper surface of said flange for removably attaching said cleat to one of said sole attachment means of said sole of said shoe, (c) a bearing portion on said opposing lower surface of said flange remote from said edge; and (d) a plurality of traction protrusions arranged on said opposing lower surface solely adjacent said edge, each of said traction protrusions having a height sufficient to engage blades of grass in said turf to provide traction substantially without puncturing said turf, each of said traction protrusions being deflectably resilient, said traction protrusions being located relative to said bearing portion such that said bearing portion substantially bears the weight of said user, substantially without said traction protrusions bearing said weight of said user, both on said turf surface and on said surface other than turf, said traction protrusions deflecting under any weight borne by them, each of said removable cleats having:

(e) an overall height measured from said upper surface of said flange to a most downwardly extending point of one of (a) said traction protrusions and (b) said bearing portion, said overall height being between about 0.07 inch (about 1.78 mm) and about 0.25 inch (about 6.35 mm).

28. The athletic shoe of claim 27 wherein said overall height is about 0.21 inch (about 5.33 mm).

29. The athletic shoe of claim 27 wherein:

each of said protrusions has a protrusion height measured from a first end of said protrusion at said flange to a second end of said protrusion remote from said flange; and said protrusion height is between about 0.07 inch (about 1.78 mm) and about 0.138 inch (about 3.5 mm).

30. The athletic shoe of claim 29 wherein said protrusion height is about 0.13 inch (about 3.3 mm).

31. The athletic shoe of claim 27 wherein said flange and said traction protrusions are molded from a first resilient elastomeric material.

32. The athletic shoe of claim 31 wherein said bearing portion is molded with said flange and said traction protrusions from said first resilient elastomeric material.

33. The athletic shoe of claim 31 wherein said bearing portion is co-molded with said flange and said traction protrusions from a second polymeric material having abrasion resistance greater said first resilient elastomeric material.

34. The athletic shoe of claim 33 wherein said first resilient elastomeric material comprises polyurethane and said second polymeric material comprises an aramid-reinforced polymer.

35. The athletic shoe of claim 31 wherein said first resilient elastomeric material comprises polyurethane.

36. The athletic shoe of claim 27 wherein said traction protrusions are arranged adjacent said edge.

37. The athletic shoe of claim 36 further comprising a gusset extending between each of said traction protrusions and said flange in a direction away from said edge.

38. The athletic shoe of claim 27 wherein each of said traction protrusions comprises a rib.

39. The athletic shoe of claim 38 wherein:

said flange is circular; and said rib lies on a radius of said flange.

40. The athletic shoe of claim 38 wherein:

said flange is circular; and said rib lies on a chord of said flange.

41. The athletic shoe of claim 38 wherein:

said ribs lie on at least one circle on said flange; and each said at least one circle is concentric with any other said at least one circle.

42. The athletic shoe of claim 38 wherein said rib has an arcuate cross section.

43. The athletic shoe of claim 38 wherein said rib has a triangular cross section.

44. The athletic shoe of claim 38 wherein said rib has a rectangular cross section.

45. The athletic shoe of claim 27 wherein each of said traction protrusions is substantially conical.

46. The athletic shoe of claim 27 wherein said bearing portion is a raised portion of said flange.

47. The athletic shoe of claim 46 wherein said raised portion comprises a domed portion.

48. The athletic shoe of claim 47 wherein said domed portion comprises at least one depressed portion.

49. The athletic shoe of claim 27 comprising between about four and about ten of said traction protrusions.

50. The athletic shoe of claim 27 further comprising a gusset extending between each of said traction protrusions and said flange in a direction away from said edge.

51. The athletic shoe of claim 27 wherein:

said edge of said flange defines a plane; and each of said traction protrusions extends from said opposing lower surface along an axis defining an angle with a normal to said plane of between about 5° inward from said edge and about 15° outward toward said edge.

52. The athletic shoe of claim 51 wherein said axis is substantially perpendicular to said plane.

53. A removable cleat for use with an athletic shoe for providing to a user traction on a turf surface while withstanding abrasion on a surface other than turf, said athletic shoe having a sole, said sole having a plurality of sole attachment means for attachment of removable cleats, said removable cleat comprising:

(a) a flange having an upper surface, an opposing lower surface and an edge;

(b) flange attachment means extending from said upper surface of said flange for removably attaching said cleat to one of said sole attachment means of said sole of said shoe; and (c) a plurality of perimeter traction protrusions circumferentially spaced solely around said edge of said flange on said lower surface to provide traction, said traction protrusions being deflectably resilient;

said flange having a central abrasion portion at the center of said lower surface, said central abrasion portion being a weight-bearing surface such as to support the majority of the body weight placed on the cleat and tending to keep weight off said traction protrusions, said traction protrusions deflecting on encountering a hard surface, to prolong the life of said traction protrusions and the golf shoe cleat.

54. A golf shoe cleat comprising:

a flange having an upper surface, an opposing lower surface and an edge;

flange attachment means extending from said upper surface of said flange for removably attaching said cleat to a sole attachment means of a sole of a shoe, and having an attachment axis;

an abrasion portion at the center of said lower surface, said abrasion portion (1) having an abrasion portion axis which is co-linear with said attachment axis, and (2) constituting a weight bearing surface such as to support the majority of the body weight placed on said golf shoe cleat; and a plurality of perimeter traction protrusions arranged solely in a circular array, solely adjacent said edge, around said abrasion portion, to provide traction, said traction protrusions being deflectably resilient;

said traction protrusions, said lower surface and said abrasion portion being adapted so that body weight is borne substantially only by the center of the cleat, said traction protrusions deflecting under any weight borne by them so that as the cleat wears, said traction protrusions wear in a manner to allow said traction protrusions to continue to provide lateral traction throughout the life of the cleat.

55. A golf shoe comprising:

a sole;

a plurality of sole attachment means on said sole for attachment of golf shoe cleats; and a plurality of golf shoe cleats, each of said golf shoe cleats comprising:

(a) a flange having an upper surface, an opposing lower surface and an edge;

(b) flange attachment means extending from said upper surface of said flange for removably attaching said cleat to one of said sole attachment means of said sole of said shoe; and (c) a plurality of perimeter traction protrusions circumferentially spaced solely around said edge of said flange on said lower surface to provide traction, said traction protrusions being deflectably resilient;

said flange having a central abrasion portion at the center of said lower surface, said central abrasion portion being a weight-bearing surface such as to support the majority of the body weight placed on the cleat and tending to keep weight off said traction protrusions, said traction protrusions deflecting on encountering a hard surface, to prolong the life of said traction protrusions and the golf shoe cleat.

56. A golf shoe comprising:

a sole;

a plurality of sole attachment means on said sole for attachment of golf shoe cleats; and a plurality of golf shoe cleats, each of said golf shoe cleats comprising:

a flange having an upper surface, an opposing lower surface and an edge;

flange attachment means extending from said upper surface of said flange for removably attaching said cleat to a sole attachment means of a sole of a shoe, and having an attachment axis;

an abrasion portion at the center of said lower surface, said abrasion portion (1) having an abrasion portion axis which is co-linear with said attachment axis, and (2) constituting a weight bearing surface such as to support the majority of the body weight placed on said golf shoe cleat; and a plurality of perimeter traction protrusions arranged solely in a circular array, solely adjacent said edge, around said abrasion portion, to provide traction, said traction protrusions being deflectably resilient;

said traction protrusions, said lower surface and said abrasion portion being adapted so that body weight is borne substantially only by the center of the cleat, said traction protrusions deflecting under any weight borne by them so that as the cleat wears, said traction protrusions wear in a manner to allow said traction protrusions to continue to provide lateral traction throughout the life of the cleat.

* * * * *

UNITED STATES PATENT AND TRADEMARK OFFICE

CERTIFICATE OF CORRECTION

PATENT NO : 6,052,923

DATED : April 25, 2000

INVENTOR(S) : Faris W. McMullin

It is certified that error appears in the above-identified patent and that said Letters Patent is hereby corrected as shown below:

Title Page under "[56] References Cited," after "5,623,774 4/1997 Abbey ..... 36/134" should be inserted
-- 5,782,017 7/1998 Ortscheid . --.

Column 3, line 27, "a" (third occurrence) should be
-- an --.

Column 4, line 24, "load bearing" should be
-- load-bearing --.

Column 6, line 37, "94 in" should be -- 94 is --;
line 61, "Weight bearing" should be
-- Weight-bearing --.

Claim 7, column 8, line 27, after "greater" should be inserted -- than --.

Claim 33, column 10, line 2, after "greater" should be inserted -- than --.

UNITED STATES PATENT AND TRADEMARK OFFICE
CERTIFICATE OF CORRECTION

PATENT NO : 6,052,923

DATED : April 25, 2000

INVENTOR(S) : Faris W. McMullin

It is certified that error appears in the above-identified patent and that said Letters Patent are hereby corrected as shown below:

Claim 54, column 11, line 24, "weight bearing" should be -- weight-bearing --.

Claim 56, column 12, line 32, "weight bearing" should be -- weight-bearing --.

Signed and Sealed this

Twenty-seventh Day of March, 2001

*Attest:*

Nicholas P. Godici

NICHOLAS P. GODICI

*Attesting Officer*

*Acting Director of the United States Patent and Trademark Office*